US011249440B2

(12) United States Patent
Bucaille

(10) Patent No.: US 11,249,440 B2
(45) Date of Patent: Feb. 15, 2022

(54) BALANCE-HAIRSPRING OSCILLATOR FOR A TIMEPIECE

(71) Applicant: PATEK PHILIPPE SA GENEVE, Geneva (CH)

(72) Inventor: Jean-Luc Bucaille, Présilly (FR)

(73) Assignee: PATEK PHILIPPE SA GENEVE, Geneva (CH)

( * ) Notice: Subject to any disclaimer, the term of this patent is extended or adjusted under 35 U.S.C. 154(b) by 680 days.

(21) Appl. No.: 16/078,952

(22) PCT Filed: Mar. 15, 2017

(86) PCT No.: PCT/IB2017/051480
§ 371 (c)(1),
(2) Date: Aug. 22, 2018

(87) PCT Pub. No.: WO2017/163148
PCT Pub. Date: Sep. 28, 2017

(65) Prior Publication Data

US 2019/0049900 A1 Feb. 14, 2019

(30) Foreign Application Priority Data

Mar. 23, 2016 (EP) ..... 16161964

(51) Int. Cl.
*G04B 17/06* (2006.01)
*G04B 17/26* (2006.01)
(Continued)

(52) U.S. Cl.
CPC ..... *G04B 17/06* (2013.01); *G04B 17/066* (2013.01); *G04B 17/26* (2013.01); *G04B 17/28* (2013.01); *G04D 7/08* (2013.01); *G04D 7/10* (2013.01)

(58) Field of Classification Search
CPC ..... G04B 17/06; G04B 17/26; G04B 17/28; G04B 17/066; G04D 7/10; G04D 7/08
See application file for complete search history.

(56) References Cited

U.S. PATENT DOCUMENTS 7,229,208 B2 * 6/2007 Verardo ..... G04B 17/066 368/175
7,344,302 B2 3/2008 Musy et al.
(Continued)

FOREIGN PATENT DOCUMENTS

CH 706798 A2 2/2014
CN 1781060 A 5/2006
(Continued)

OTHER PUBLICATIONS

Office Action issued in Chinese Patent Application No. 201780019397.0 dated Mar. 26, 2020 with English translation provided.
(Continued)

*Primary Examiner* — Sean Kayes
(74) *Attorney, Agent, or Firm* — Nixon & Vanderhye

(57) ABSTRACT

In an oscillator for a timepiece including a balance and a hairspring, the balance lacks equilibrium, such that: the curves for running of the oscillator owing to weight of the hairspring as a function of the oscillation amplitude of the balance in at least four vertical positions of the oscillator spaced by 90° each pass through 0 at an oscillation amplitude of the balance between 200° and 240°; and between oscillation amplitudes of 150° and 280°, curves representing the running of the oscillator owing to lack of equilibrium in the balance as a function of the oscillation amplitude in the vertical positions each has an average slope of opposite sign to the average slope of the corresponding curve among the curves representing the running of the oscillator owing to the
(Continued)

weight of the hairspring. A reduction in the running discrepancies between the vertical positions can thus be achieved.

20 Claims, 6 Drawing Sheets

(51) Int. Cl.

| | |
|---|---|
| ***G04B 17/28*** | (2006.01) |
| ***G04D 7/10*** | (2006.01) |
| ***G04D 7/08*** | (2006.01) |

(56) References Cited

U.S. PATENT DOCUMENTS

| | | | | |
|---|---|---|---|---|
| 8,047,705 | B2 * | 11/2011 | Hessler | G04B 17/345 368/177 |
| 8,348,497 | B2 | 1/2013 | Daout | |
| 8,480,294 | B2 * | 7/2013 | Helfer | G04B 17/066 368/175 |
| 9,004,748 | B2 * | 4/2015 | Helfer | G04B 17/063 368/175 |
| 9,134,701 | B2 | 9/2015 | Bucaille | |
| 9,323,223 | B2 | 4/2016 | Bucaille | |
| 2005/0281137 | A1 * | 12/2005 | Bourgeois | F16F 1/10 368/175 |
| 2006/0055097 | A1 | 3/2006 | Conus et al. | |
| 2014/0192627 | A1 | 7/2014 | Bucaille | |
| 2015/0338829 | A1 | 11/2015 | Bossart et al. | |
| 2017/0123380 | A1 * | 5/2017 | Winkler | G04B 17/28 |

FOREIGN PATENT DOCUMENTS

| | | | |
|---|---|---|---|
| CN | 1985103 | A | 6/2007 |
| CN | 103930837 | A | 7/2014 |
| CN | 104520775 | A | 4/2015 |
| EP | 1 445 670 | A1 | 8/2004 |
| EP | 1473604 | A1 | 11/2004 |
| EP | 1780611 | A2 | 5/2007 |
| EP | 2299336 | A2 | 3/2011 |
| WO | 2013/034962 | A1 | 3/2013 |
| WO | 2014/001341 | A1 | 1/2014 |
| WO | 2014/072781 | A2 | 5/2014 |
| WO | 2015/132259 | A2 | 9/2015 |

OTHER PUBLICATIONS

Jean Piranda et al: "De la conception pragmatique à la conception assistée par ordinateur évolution du spiral de balancier" Annales Francaises de Chronometrie et de Micromecanique: Publication Trimestrielle de la Societe Chronometrique de France., Jan. 1, 2011 (Jan. 1, 2011), pp. 71-82, XP055302311.

International Search Report, dated Jul. 31, 2017, from corresponding PCT/IB2017/051480 application.

* cited by examiner

BALANCE-HAIRSPRING OSCILLATOR FOR A TIMEPIECE

BACKGROUND OF THE INVENTION

Field of the Invention

The present invention relates to a balance-hairspring-type oscillator for a timepiece, more particularly an oscillator of this type with improved isochronism. isochronism is understood to be the variations in running as a function of the oscillation amplitude of the balance and as a function of the position of the timepiece. The smaller these variations, the more isochronous is the oscillator.

The running of a balance-hairspring oscillator is equal to the sum of the running owing to the lack of equilibrium in the balance and of the running owing to the hairspring. In a vertical position, the lack of equilibrium, or imbalance, in the balance disrupts the regularity of the oscillations. In order to minimise this disruption it is common to rebalance the balance by milling or by means of adjusting screws provided on the balance. The variations in running owing to the hairspring are principally caused by the eccentric development and the weight of the hairspring. The eccentric development of the hairspring generates a disruptive torque, the same in all positions, created by the restoring forces between the pivots of the shaft of the oscillator and the bearings in which they turn. The weight of the hairspring generates another disruptive torque in dependence upon the inclination of the timepiece with respect to the horizontal position.

Description of the Related Art

In recent years, improvements have been made to the geometry of hairsprings in order to reduce the extent to which they impair the isochronism of the oscillator. In particular, the patent applications EP 1445670, EP 1473604, EP 2299336 and WO 2014/072781 may be cited which describe hairsprings comprising variations in rigidity and/or pitch along their blade. Modern manufacturing techniques and materials such as silicon permit production of such hairsprings. However, this approach consisting of dealing with the running owing to the hairspring separately from the running owing to the balance limits the possible gain in terms of overall isochronism of the oscillator. In fact, it appears difficult to reduce further the discrepancies in running between the vertical positions owing to the hairspring. In spite of the variety of hairspring geometries which have been proposed, it is not possible, or is extremely difficult, to reduce discrepancies in running to less than about 1 second/day for the hairspring. With respect to the balance, it is almost impossible to produce balances having an imbalance of less than 0.5 μg·cm when producing them on an industrial scale.

BRIEF SUMMARY OF THE INVENTION

The present invention aims to propose another approach for improving the isochronism of a balance-hairspring oscillator and in particular for reducing the discrepancies in running between the different vertical positions thereof.

For this purpose an oscillator for a timepiece is provided, comprising a balance and a hairspring, the balance having a lack of equilibrium, characterised in that the lack of equilibrium in the balance and the geometry of the hairspring are such that a) the curves representing the running of the oscillator owing to the weight of the hairspring as a function of the oscillation amplitude of the balance in at least four vertical positions of the oscillator spaced apart by 90°, preferably in all the vertical positions, each pass through the value zero at an oscillation amplitude of the balance between 200° and 240°, preferably between 210° and 230°, more preferably between 215° and 225°;

b) between the oscillation amplitude of 150° and the oscillation amplitude of 280°, the curves representing the running of the oscillator owing to the lack of equilibrium in the balance as a function of the oscillation amplitude of the balance in said vertical positions of the oscillator each have an average slope of opposite sign to the average slope of the corresponding curve among said curves representing the running of the oscillator owing to the weight of the hairspring.

Thus the present invention proposes designing the balance and the hairspring such that the running owing to the lack of equilibrium in the balance and the running owing to the weight of the hairspring compensate for each other at least partially and preferably substantially entirely over all, or almost all, of the range of normal operation of the balance. In contrast to the prior art, the present invention thus does not seek to remove the imbalance of the balance, this imbalance can even be considerable. Similarly, there is no attempt to reduce the running owing to the weight of the hairspring to a minimum. This novel approach makes it possible to achieve very slight discrepancies in running between the different vertical positions of the oscillator and thus improves the precision of the timepiece.

In practice, the oscillation amplitude at which the curves representing the running of the oscillator owing to the weight of the hairspring pass through zero can differ slightly from one curve to another. Said curves preferably pass through zero at the same oscillation amplitude and thus intersect at a single point.

In preferred exemplified embodiments, the lack of equilibrium in the balance and the geometry of the hairspring are such that the average slope of each curve among said curves representing the running of the oscillator owing to the lack of equilibrium in the balance has substantially the same absolute value as the average slope of the corresponding curve among said curves representing the running of the oscillator owing to the weight of the hairspring, in the range of oscillation amplitudes of 150° to 280°.

The lack of equilibrium in the balance and the geometry of the hairspring can be such that the maximum discrepancy in the running of the oscillator owing to the lack of equilibrium in the balance and to the weight of the hairspring between said vertical positions in the range of oscillation amplitudes of 150° to 280° is less than 4 seconds/day, or even less than 2 seconds/day, or even less than 1 second/day, or even less than 0.7 seconds/day.

The distance between the inner end of the hairspring and the centre of rotation of the hairspring can be greater than 500 μm, or greater than 600 μm, or even greater than 700 μm.

The imbalance of the balance can be greater than 0.5 μg·cm, or even greater than 1 μg·cm.

In typical exemplified embodiments, the inner turn of the hairspring has a stiffened portion and/or is shaped as a Grossmann curve. The outer turn of the hairspring can also have a stiffened portion.

In other exemplified embodiments, the hairspring has a stiffness and/or a pitch which vary continuously over at least several turns.

BRIEF DESCRIPTION OF THE DRAWINGS

Other features and advantages of the present invention will become clear upon reading the following detailed description given with reference to the attached drawings in which.

DETAILED DESCRIPTION OF THE PREFERRED EMBODIMENTS

Figure 1:
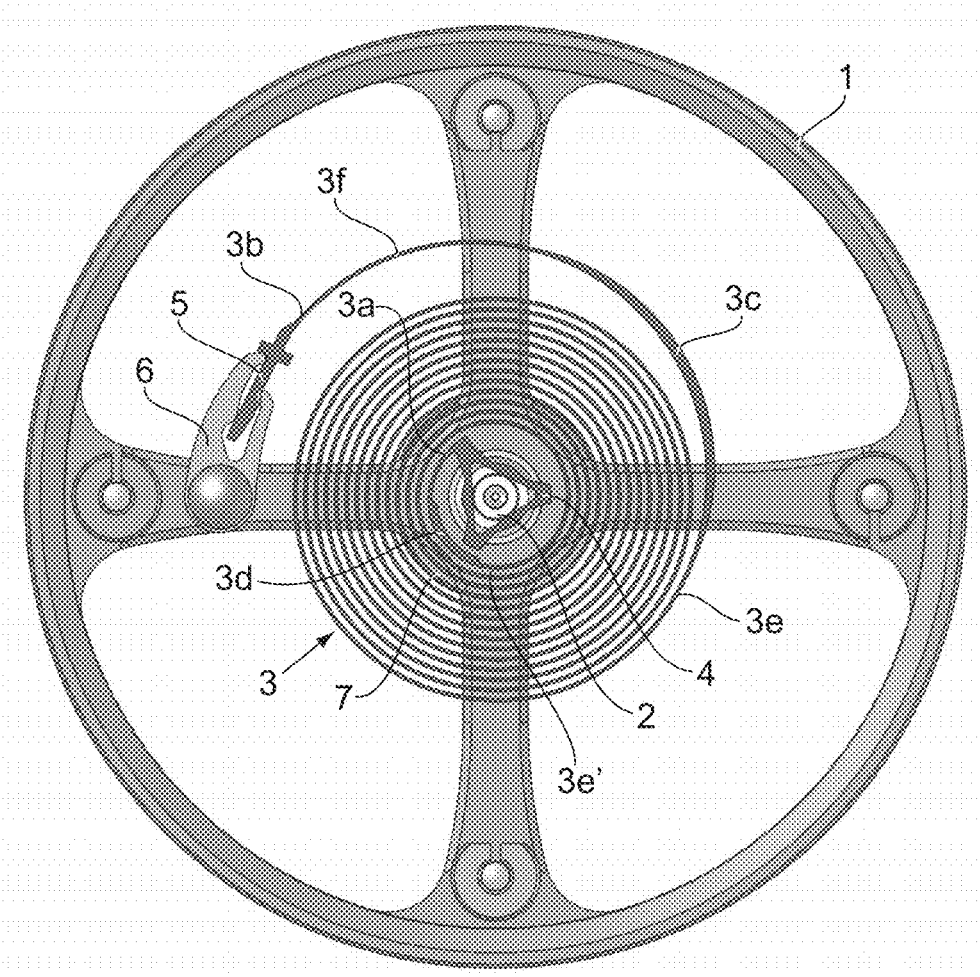
FIG. 1 shows a balance-hairspring oscillator in accordance with a first embodiment of the invention.
Figure 2:
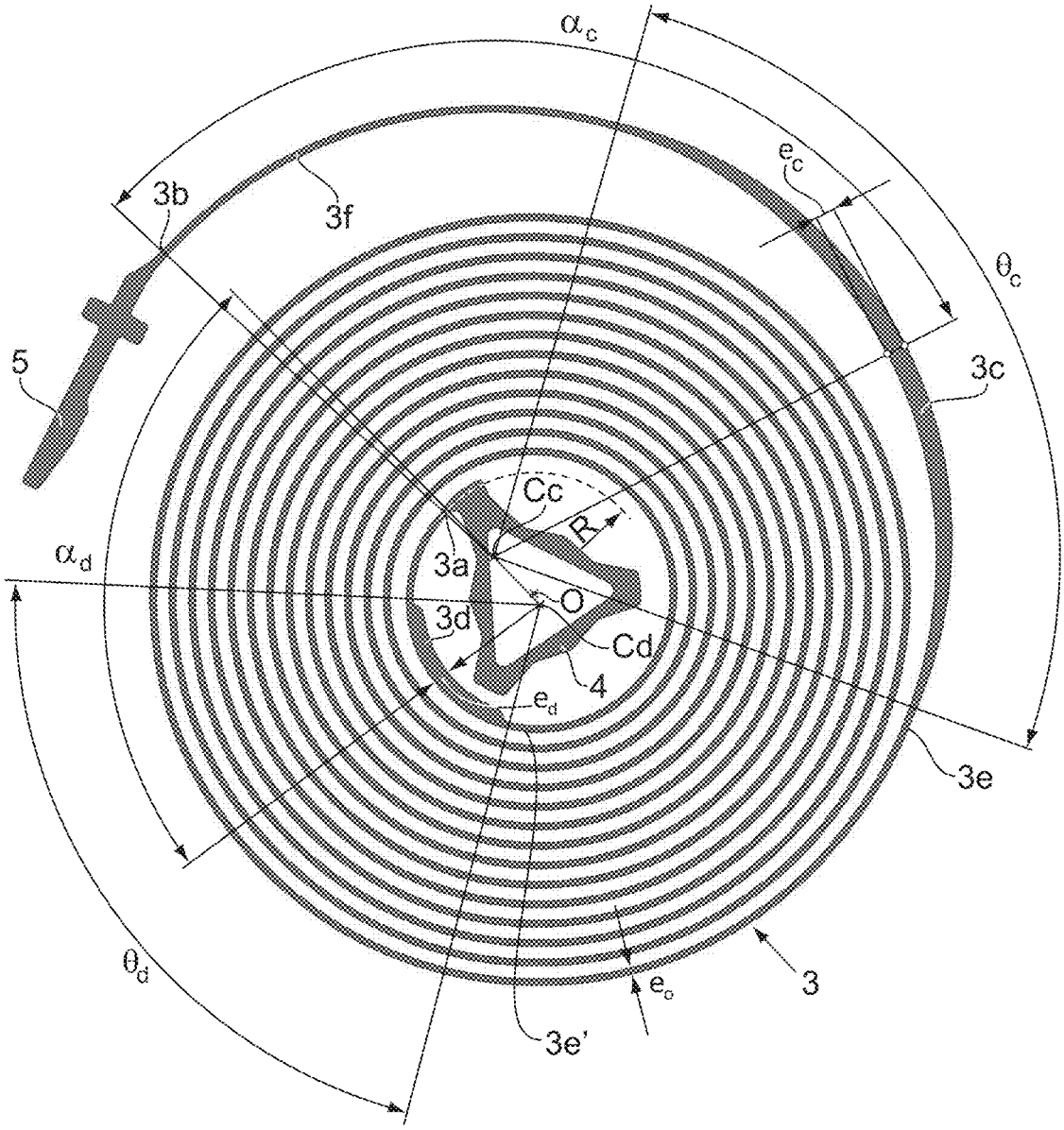
FIG. 2 shows the hairspring of the oscillator in accordance with the first embodiment of the invention.
Figure 3:
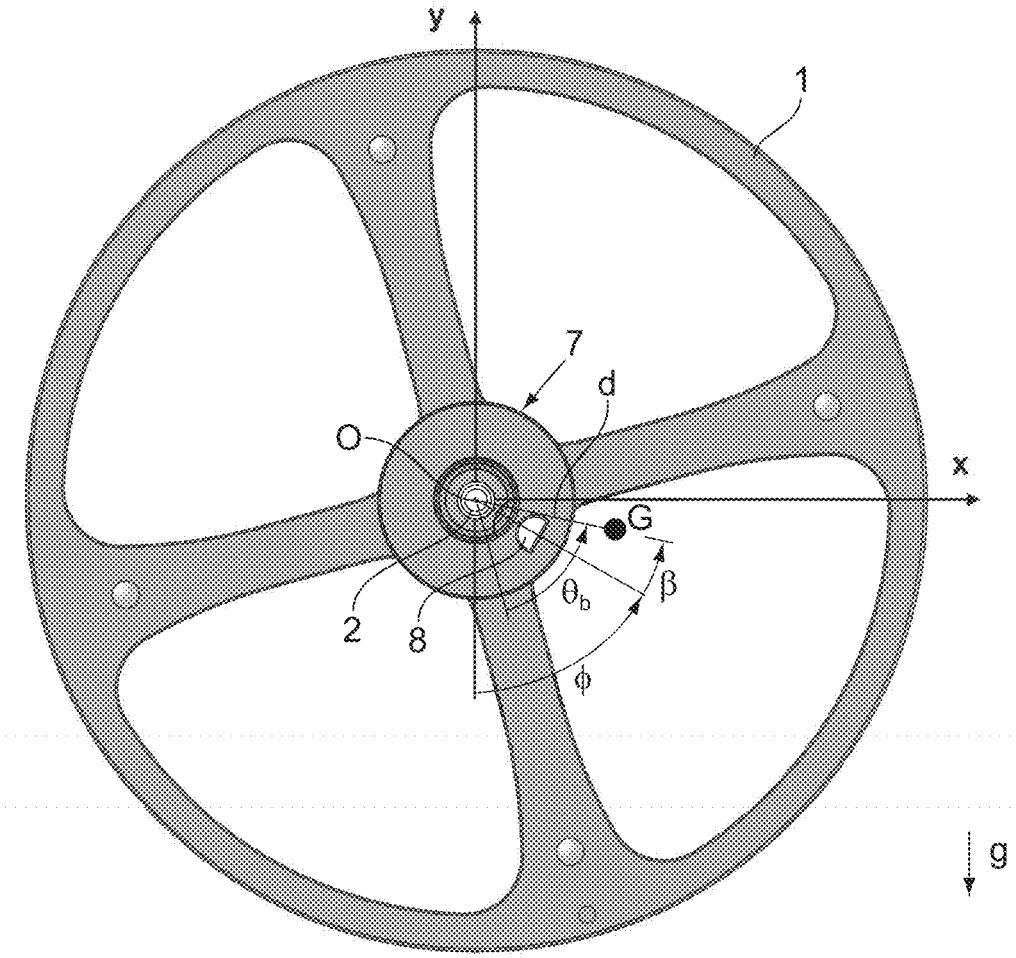
FIG. 3 shows the balance of the oscillator in accordance with the invention, seen from the other side with respect to FIG. 1.

With reference to FIGS. 1 to 3, a balance-hairspring oscillator according to a first embodiment of the invention, for a timepiece movement intended for use in a timepiece such as a wristwatch or pocket watch, comprises a balance 1 mounted on a balance shaft 2 and a hairspring 3 with its inner end 3*a* fixed to the balance shaft 2 by means of a collet 4 and of which the outer end 3*b* is fixed to the frame of the movement by means of one or a plurality of members. In the illustrated example, the outer end 3*b* of the hairspring 3 is extended by a rigid fixing part 5 which is held by a clip 6 mounted on the frame of the movement as described in patent EP 1780611 of the applicant. However, the outer end 3*b* could be fixed to the frame in another way, e.g. by means of a traditional hairspring stud. The assembly comprising the hairspring 3, the collet 4 and the rigid fixing part 5 can be monolithic and be produced e.g. of silicon or diamond. The balance shaft 2 also carries a roller or double roller 7 itself carrying an impulse pin 8 and forming part of an escapement serving to maintain and count the oscillations of the oscillator.

The hairspring 3 is not in the traditional form of an Archimedean spiral with a constant blade cross-section. The geometry of the hairspring is actually irregular in the sense that it has a cross-section and/or a pitch which vary along its blade. In the illustrated example, a portion 3*c* of the outer turn (hereinunder referred to as the "outer stiffened portion") and a portion 3*d* of the inner turn (hereinunder referred to as the "inner stiffened portion") have a larger cross-section, and thus a greater stiffness, than the rest of the blade forming the hairspring 3. Outside of these portions 3*c* and 3*d*, the cross-section of the blade is constant. The pitch of the hairspring 3 is constant from a point 3*e*' located on its inner turn as far as a point 3*e* located on its outer turn. The pitch increases slightly from the inner end 3*a* to the point 3*e*'. After the point 3*e*, the pitch increases distinctly, the outer turn moving away from the penultimate turn with respect to the course of the Archimedean spiral in order to avoid these two turns touching each other during expansions of the hairspring. The end part 3*f* of the hairspring 3 extending between the points 3*e* and 3*b* comprises at least part, typically all, of the outer stiffened portion 3*c*.

However, numerous other geometries of the hairspring 3 are possible. For example, in place of, or in addition to, the inner stiffened portion 3*d*, the inner turn could be shaped as a Grossmann curve. It would also be possible not to have an outer stiffened portion 3*c*. In other variations, instead of changing the cross-section of the blade of the hairspring only locally at the inner turn and outer turn, it would be possible to change the cross-section continuously all along the blade or over several turns, i.e. over a number (not necessarily an integer number) of the turns greater than 1, e.g. equal to 2 or more. It would also be possible to vary the pitch of the hairspring continuously all along the blade or over several turns in place of, or in addition to, the variation in cross-section. Furthermore, it would be possible to vary the stiffness of the hairspring along its blade in a different way than by changing its cross-section, e.g. by doping or heat treatment.

The running of a balance-hairspring oscillator is equal to the sum of the running owing to the balance and of the running owing to the hairspring. The balance influences running only in the vertical positions. The running of the oscillator owing to the balance is caused by the lack of equilibrium in the balance, i.e. by the fact that, by reason of manufacturing tolerances, the centre of gravity of the balance is not on the axis of rotation thereof. With reference to FIG. 3, if d is used to define the radial position of the centre of gravity G of the balance 1 (with respect to the centre of rotation O of the balance, in projection in a plane perpendicular to the axis of rotation 2) and $M_b$ is used to define the mass of the balance, the magnitude $A=d \cdot M_b$ is the imbalance of the balance. As will be shown hereinunder, the imbalance A of the balance and the angular position $\theta_b$ of its centre of gravity G (defined e.g. with respect to an arm of the balance, in projection in a plane perpendicular to the axis of rotation 2, as illustrated in FIG. 3) are parameters of adjustment of the running owing to the lack of equilibrium in the balance. The hairspring influences running in the horizontal position and in the vertical positions. In the bearings of the balance shaft, the eccentric development of the hairspring causes reactions which vary, this occurring in all positions of the oscillator. Furthermore, in the vertical positions, the displacement of the centre of gravity of the hairspring caused by the eccentric development thereof creates a lack of isochronism owing to the weight of the hairspring applied to said centre of gravity. This disruption is different from the effect of elastic sagging of the hairspring owing to gravity which is not considered in the present invention.

According to the theory, the curve representing the running of the oscillator owing to the lack of equilibrium in the balance as a function of the oscillation amplitude of the balance, in any vertical position thereof, passes through the value zero (i.e. crosses the abscissa axis) at an oscillation amplitude of 220°. Also according to the theory, for a hairspring with a constant blade cross-section in the form of a perfect Archimedean spiral, the curve representing the running of the oscillator owing to the weight of the hairspring as a function of the oscillation amplitude of the balance, in any vertical position thereof, passes through the value zero (i.e. crosses the abscissa axis) at oscillation amplitudes of 163.5° and 330.5°.

The present invention is based on the observation that it is possible to select balance parameters A, $\theta_b$ and hairspring geometries so that the running owing to the lack of equilibrium in the balance and the running owing to the weight of the hairspring compensate for each other, thus permitting the discrepancies in running between the different vertical positions to be reduced, or even to be substantially cancelled out.

In the example of FIG. 2, the hairspring 3 has 14 turns. The thickness $e_0$ of the blade forming the hairspring, measured on a radius from the centre of rotation O of the hairspring, is 28.1 μm, except along the outer stiffened portion 3*c* and the inner stiffened portion 3*d* where it is greater. The pitch of the hairspring between the points 3*e*' and 3*e* is 86.8 μm. The radius R of the collet 4, i.e. the distance between the inner end 3*a* of the hairspring and the centre O, defined as the radius of the circle whose centre is O and which passes through the middle (at half the thickness $e_0$) of the inner end 3*a*, is 545 μm. The maximum thickness $e_d$ of the inner stiffened portion 3*d*, measured on a radius from the centre of curvature Cd of the start of the inner turn (between the points 3*a* and 3*e*'), is 73 μm. The angular extent $\theta_d$ of the inner stiffened portion 3*d*, measured from the centre of curvature Cd, is 78°. Its angular position $\alpha_d$ (position of its centre with respect to the inner end 3*a*), measured from the centre of curvature Cd, is 82°. The maximum thickness $e_c$ of the outer stiffened portion 3*c*, measured on a radius from the centre of curvature Cc of the end part 3*f* of the hairspring 3 is 88 μm. The angular extent $\theta_d$ and the angular position $\alpha_d$ (position of its centre with respect to the outer end 3*b* of the hairspring 3) of the outer stiffened portion 3*c*, measured from the centre of curvature Cc, are respectively 94° and 110°.

Figure 4:
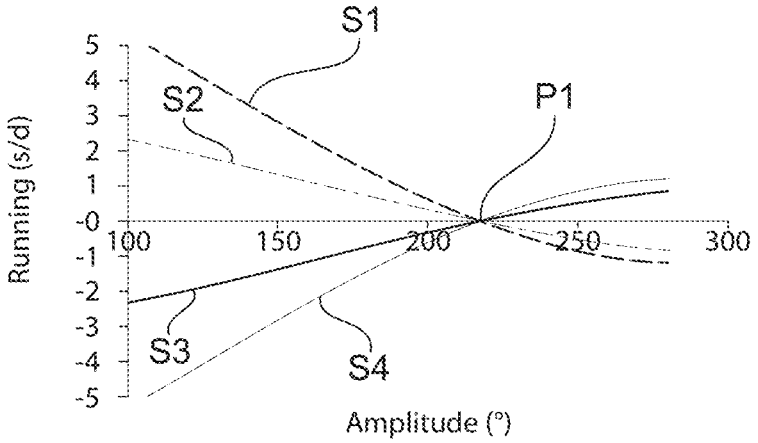
FIG. 4 shows curves representing the running of the oscillator owing to the weight of the hairspring in accordance with the first embodiment of the invention.

FIG. 4 shows the running of the oscillator 1, 2, 3 owing to the weight of the hairspring 3 as a function of the oscillation amplitude of the balance 1 in each of four vertical positions of the oscillator spaced by 90°, i.e. a high vertical position VH (3 o'clock at the top) (curve S1), a right vertical position VD (12 o'clock at the top) (curve S2), a left vertical position VG (6 o'clock at the top) (curve S3) and a low vertical position VB (9 o'clock at the top) (curve S4). On the abscissa axis of the diagram of FIG. 4, the oscillation amplitude of the balance 1 is plotted, expressed in degrees with respect to the equilibrium position, and on the ordinate axis, the running in seconds per day (s/d) is represented. Each curve S1 to S4 has been produced using the following formula:

$$\mu(\theta_0) = -86400 \cdot \frac{M_s \cdot L}{E \cdot I} \cdot g \cdot \frac{1}{2 \cdot \pi \cdot \theta_0^2} \int_0^{2\cdot\pi} \frac{\delta y_g(\theta(\varphi))}{\delta\theta} \cdot \theta(\varphi) \cdot d\varphi$$

proposed in the work "Traité de construction horlogère" ["Treatise on watch-making construction"] by M. Vermot, P. Bovay, D. Prongué and S. Dordor, edited by Presses polytechniques et universitaires romandes, 2011, where μ is the running, $M_s$ is the mass of the hairspring, L is the length of the hairspring, E is the Young's modulus of the hairspring, I is the second moment of area of the hairspring, g is the gravitational constant, θ is the elongation of the balance with respect to its equilibrium position, $\theta_0$ is the amplitude of the balance with respect to its equilibrium position, φ is the phase ($\theta=\theta_0 \cos \varphi$), $y_g$ is the ordinate of the centre of gravity of the hairspring in the coordinate system (O, x, y) of FIG. 3 where the y axis is opposite to gravity, and δ designates the derivative. The displacement of the centre of gravity of the hairspring (variation in the magnitude $y_g$) has been calculated by finite elements. The derivative and the integral have then been calculated numerically.

As shown, the curves S1 to S4 intersect at a point P1 located on the abscissa axis at an oscillation amplitude of about 218°, an amplitude which is thus close to the oscillation amplitude of 220° at which the corresponding curves of a balance intersect. The part of the hairspring 3 which has most influence on the position of the point of intersection P1 is the inner stiffened portion 3*d*. The outer stiffened portion 3*c* makes it possible to refine the adjustment of the point of intersection P1, and/or to produce an advance in running which compensates for a loss in running caused by the escapement as described in patent applications WO 2013/034962 and WO 2014/072781 of the present applicant. In practice, the intersection at the point P1 or in the proximity of the point P1 takes place in all the vertical positions of the oscillator.

Figure 5:
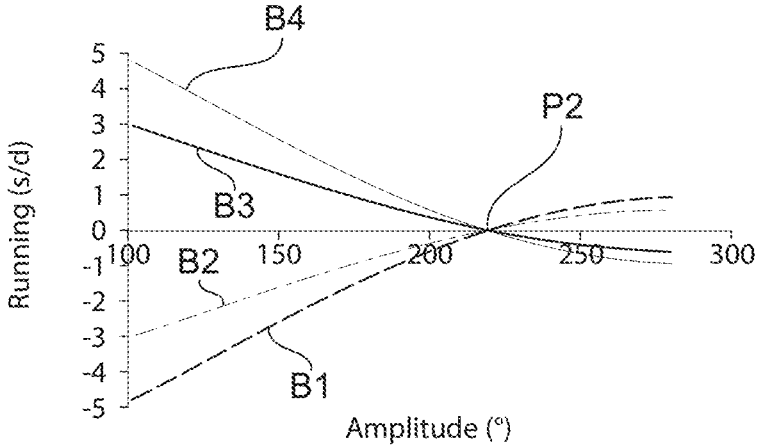
FIG. 5 shows curves representing the running of the oscillator owing to the lack of equilibrium in the balance in accordance with the first embodiment of the invention.

FIG. 5 shows the running of the oscillator 1, 2, 3 owing to the lack of equilibrium in the balance 1 as a function of the oscillation amplitude of the balance 1 in each of the four afore-mentioned vertical positions of the oscillator, i.e. the high vertical position VH (curve B1), the right vertical position VD (curve B2), the left vertical position VG (curve B3) and the low vertical position VB (curve B4). Each curve B1 to B4 has been produced using the following formula:

$$\mu(\theta_0) = 86400 \cdot \frac{M_b \cdot g \cdot d}{J_b \cdot \omega_0^2} \cdot \frac{J_1(\theta_0)}{\theta_0} \cdot \cos(\phi + \beta)$$

proposed in the afore-mentioned work "Traité de construction horlogère" where μ is the running, $\theta_0$ is the amplitude of the balance with respect to its equilibrium position, $M_b$ is the mass of the balance, g is the gravitational constant, d is the radial position of the centre of gravity of the balance, $J_b$ is the moment of inertia of the balance, $\omega_0$ is the natural angular frequency of the oscillator, $J_1$ is the Bessel function of order 1 (which is cancelled out for a value of $\theta_0$ of about 220°), β is the angular position of the centre of gravity of the balance with respect to the impulse pin 8 (cf. FIG. 3; $\beta=\theta_b-45°$) and ϕ is the angular position of the impulse pin 8 with respect to the direction of gravity.

More particularly, the diagram of FIG. 5 is that of a balance having an imbalance A of 0.6 μg·cm and of which the angular position $\theta_b$ of the centre of gravity is 60°. It will be noted that the slope, in particular the average slope, of each curve B1 to B4 is of opposite sign to that of the slope, in particular the average slope, of each curve S1 to S4 respectively. In other words, the curves S1 and S2 decrease while the curves B1 and B2 increase, and the curves S3 and S4 increase while the curves B3 and B4 decrease. This is true in particular in the usual range of operation of a balance in a vertical position, i.e. the range of oscillation amplitudes from 150° to 280°. This feature relating to the slopes of the curves S1 to S4 and B1 to B4 combined with the fact that the point of intersection P1 of the curves S1 to S4 is close to the point of intersection P2, at 220°, of the curves B1 to B4, allows for the running owing to the lack of equilibrium in the balance 1 and the running owing to the weight of the hairspring 3 to compensate for each other, at least partially. The average slope of each curve S1 to S4 is preferably of substantially the same absolute value as the average slope of the corresponding curve B1 to B4 in the range of oscillation amplitudes of 150° to 280°. The adjustment of the slopes of the curves B1 to B4 during design of the oscillator is effected by causing variation in the imbalance A of the balance and the angular position $\theta_b$ of its centre of gravity. With a constant imbalance A, causing variation in the angular position $\theta_b$ of the centre of gravity of the balance changes the relative position of the curves B1 to B4. It is thus appropriate to choose a value $\theta_b$ such that the order of the curves B1 to B4 (depending on their slope) is reversed from that of the curves S1 to S4. With a constant value $\theta_b$, causing variation in the imbalance A increases or decreases the slope of each curve B1 to B4, which makes it possible to optimise the degree of compensation between the balance and the hairspring.

Figure 6:
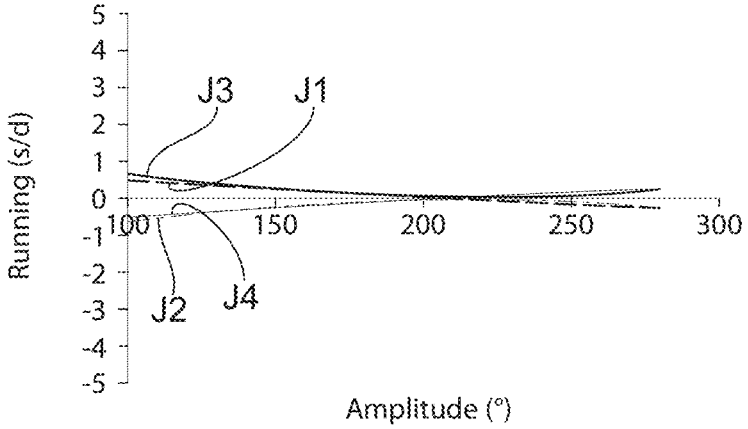
FIG. 6 shows curves representing the running of the oscillator owing both to the lack of equilibrium in the balance and to the weight of the hairspring in accordance with the first embodiment of the invention.

FIG. 6 shows the running of the oscillator owing to the lack of equilibrium in the balance and to the weight of the hairspring (sum of the running owing to the lack of equilibrium in the balance and of the running owing to the weight of the hairspring) in each of the four afore-mentioned vertical positions, i.e. the high vertical position VH (curve J1), the right vertical position VD (curve J2), the left vertical position VG (curve J3) and the low vertical position VB (curve J4). It may be noted that the discrepancies in running between these vertical positions are very slight, the maximum running discrepancy in the range of oscillation amplitudes of 150° to 280° being less than 0.7 s/d.

In practice, on a manufactured balance, it is possible to adjust the imbalance A and the angular position $\theta_b$ of the centre of gravity by milling and/or by means of adjusting screws provided on the balance and/or by means of inertia blocks provided on the balance. However, in order to facilitate manufacture and adjustment of the balance, provision is made according to a second embodiment of the invention for choosing a greater imbalance A. However, increasing the imbalance A causes an increase in the slope of the curves B1 to B4. In order to permit the hairspring to compensate for the running owing to the lack of equilibrium in the balance, provision is also made according to this second embodiment of the invention to increase the radius of the collet 4 in order to increase the slope of the curves S1 to S4.

Figure 7:
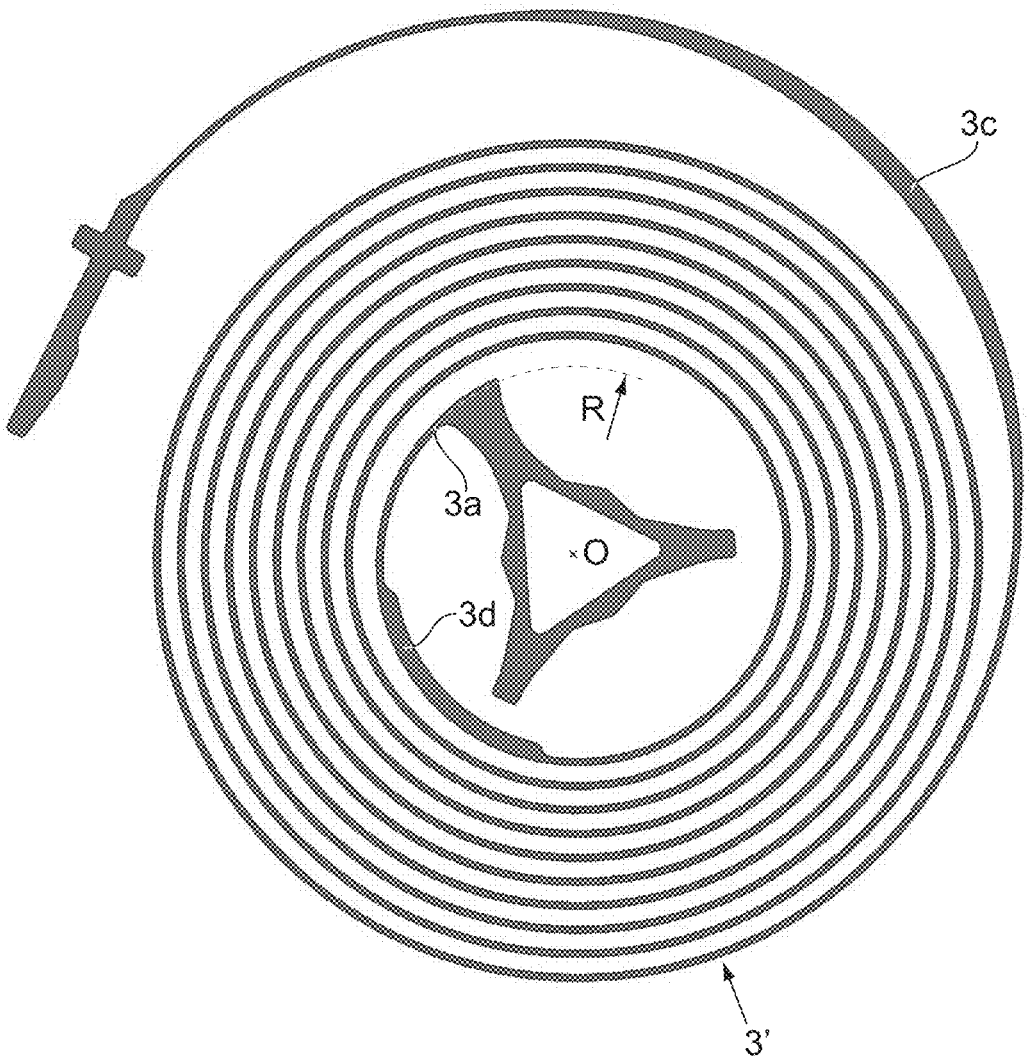
FIG. 7 shows the hairspring of an oscillator in accordance with a second embodiment of the invention.

Thus, FIG. 7 shows a hairspring 3' of the same type as the hairspring 3 illustrated in FIG. 2 but where the collet radius R has been increased from 545 μm to 760 μm. The values $e_0$, $e_c$, $e_d$, $\theta_c$, $\theta_d$, $\alpha_c$, $\alpha_d$, measured in the same way as for the hairspring 3, are as follows:

$e_0$=25.9 μm
$e_c$=86 μm
$e_d$=71 μm
$\theta_c$=94°
$\theta_d$=78°
$\alpha_c$=90°
$\alpha_d$=88°

The pitch of the hairspring 3' is 96.5 μm. The number of turns is 10.

Figure 8:
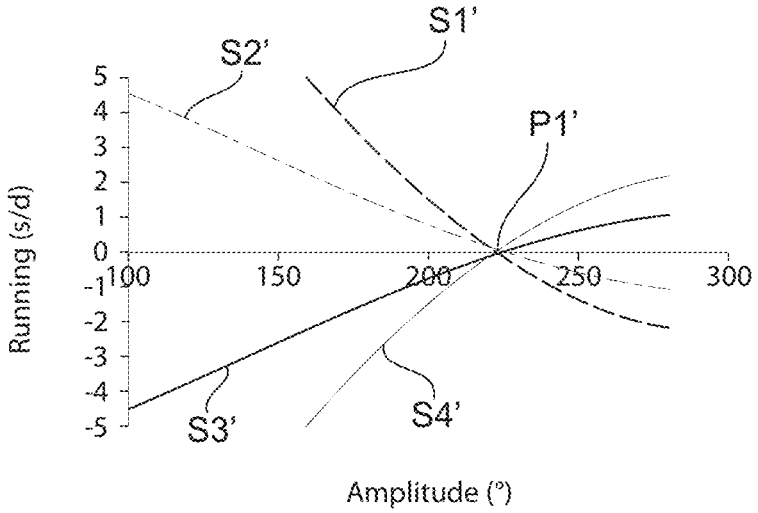
FIG. 8 shows curves representing the running of the oscillator owing to the weight of the hairspring in accordance with the second embodiment of the invention.

FIG. 8 shows the running of the oscillator 1, 2, 3' owing to the weight of the hairspring 3' as a function of the oscillation amplitude of the balance 1 in each of the four afore-mentioned vertical positions, i.e. the high vertical position VH (curve S1'), the right vertical position VD (curve S2'), the left vertical position VG (curve S3') and the low vertical position VB (curve S4'). These curves S1' to S4' intersect substantially at a point P1' located on the abscissa axis and corresponding to an oscillation amplitude of the balance of about 223°.

Figure 9:
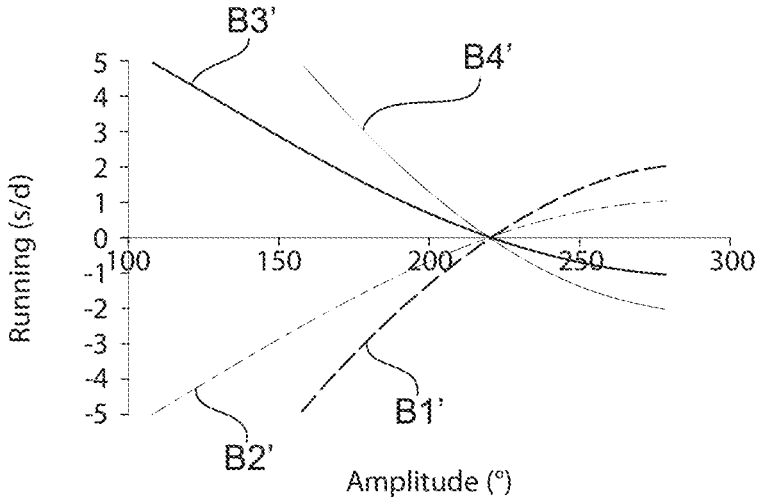
FIG. 9 shows curves representing the running of the oscillator owing to the lack of equilibrium in the balance in accordance with the second embodiment of the invention.

FIG. 9 shows the running of the oscillator 1, 2, 3' owing to the lack of equilibrium in the balance 1 as a function of the oscillation amplitude of the balance 1 in each of the four afore-mentioned vertical positions, i.e. the high vertical position VH (curve B1'), the right vertical position VD (curve B2'), the left vertical position VG (curve B3') and the low vertical position VB (curve B4'). The diagram of FIG. 9 has been produced with a balance having an imbalance A of 1.25 μg·cm and of which the angular position $\theta_b$ of the centre of gravity is 55°. It may be noted that the slopes of the curves S1' to S4' and the slopes of the curves B1' to B4' permit running compensation between the balance 1 and the hairspring 3'.

Figure 10:
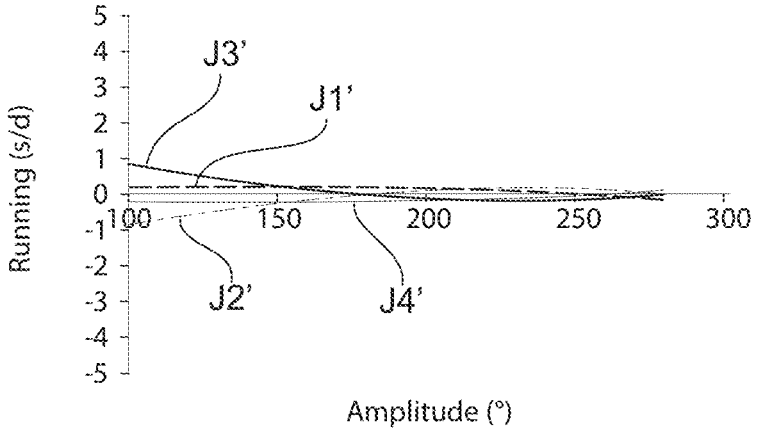
FIG. 10 shows curves representing the running of the oscillator owing both to the lack of equilibrium in the balance and to the weight of the hairspring in accordance with the second embodiment of the invention.

FIG. 10 shows the running of the oscillator 1, 2, 3' owing to the lack of equilibrium in the balance 1 and to the weight of the hairspring 3' (sum of the running owing to the lack of equilibrium in the balance 1 and of the running owing to the weight of the hairspring 3') in each of the four afore-mentioned vertical positions, i.e. the high vertical position VH (curve J1'), the right vertical position VD (curve J2'), the left vertical position VG (curve J3') and the low vertical position VB (curve J4'). It may be noted that the discrepancies in running between these vertical positions are very slight, the maximum running discrepancy in the range of oscillation amplitudes of 150° to 280° being less than 0.7 s/d.

The exemplified embodiments described above are in no way limiting. It goes without saying that numerous configurations are possible in order to implement the invention as claimed.

The invention claimed is:

1. An oscillator for a timepiece, comprising:

a balance (1); and a hairspring (3; 3'), the balance having a lack of equilibrium, wherein the lack of equilibrium in the balance and the geometry of the hairspring are such that a) first curves (S1-S4; S1'-S4') representing the running of the oscillator owing to the weight of the hairspring as a function of the oscillation amplitude of the balance in at least four vertical positions of the oscillator spaced apart by 90° each pass through a value zero of running at an oscillation amplitude of the balance between 200° and 240°; and b) between the oscillation amplitude of 150° and the oscillation amplitude of 280°, second curves (B1-B4; B1'-B4') representing the running of the oscillator owing to the lack of equilibrium in the balance as a function of the oscillation amplitude of the balance in said vertical positions of the oscillator each have an average slope of opposite sign to the average slope of a corresponding curve among said first curves (S1-S4; S1'-S4') representing the running of the oscillator owing to the weight of the hairspring, wherein said first curves are obtained by the following formula:

$$\mu(\theta_0) = -86400.\frac{M_s.L}{E.I}.g.\frac{1}{2.\pi.\theta_0^2}\int_0^{2\pi}\frac{\delta y_g(\theta(\varphi))}{\delta\theta}.\theta(\varphi).d\varphi$$

and said second curves are obtained by the following formula:

$$\mu(\theta_0) = 86400.\frac{M_b.g.d}{J_b.\omega_0^2}.\frac{J_1(\theta_0)}{\theta_0}.\cos(\phi+\beta)$$

where μ is the running, $M_s$ is the mass of the hairspring, L is the length of the hairspring, E is the Young's modulus of the hairspring, I is the second moment of area of the hairspring, g is the gravitational constant, θ is the elongation of the balance with respect to its equilibrium position, $\theta_0$ is the amplitude of the balance with respect to its equilibrium position, φ is the phase, $y_g$ is the ordinate of the center of gravity of the hairspring in a coordinate system (O, x, y) where the y axis is opposite to gravity, $M_b$ is the mass of the balance, d is the radial position of the center of gravity of the balance, $J_b$ is the moment of inertia of the balance, $\omega_o$ is the natural angular frequency of the oscillator, $J_1$ is the Bessel function of order 1, β is the angular position of the center of gravity of the balance with respect to an impulse pin of the balance and ϕ is the angular position of the impulse pin with respect to the direction of gravity.

2. The oscillator as claimed in claim 1, wherein the geometry of the hairspring is such that said first curves (S1-S4; S1'-S4') representing the running of the oscillator owing to the weight of the hairspring each pass through the value zero at an oscillation amplitude of the balance between 210° and 230°.

3. The oscillator as claimed in claim 2, wherein the geometry of the hairspring is such that said first curves (S1-S4; S1'-S4') representing the running of the oscillator owing to the weight of the hairspring each pass through the value zero at an oscillation amplitude of the balance between 215° and 225°.

4. The oscillator as claimed in claim 3, wherein the lack of equilibrium in the balance and the geometry of the hairspring are such that the average slope of each curve among said second curves (B1-B4; B1'-B4') representing the running of the oscillator owing to the lack of equilibrium in the balance has substantially the same absolute value as the average slope of the corresponding curve among said first curves (S1-S4; S1'-S4') representing the running of the oscillator owing to the weight of the hairspring, in the range of oscillation amplitudes of 150° to 280°.

5. The oscillator as claimed in claim 2, wherein the lack of equilibrium in the balance and the geometry of the hairspring are such that the average slope of each curve among said second curves (B1-B4; B1'-B4') representing the running of the oscillator owing to the lack of equilibrium in the balance has substantially the same absolute value as the average slope of the corresponding curve among said first curves (S1-S4; S1'-S4') representing the running of the oscillator owing to the weight of the hairspring, in the range of oscillation amplitudes of 150° to 280°.

6. The oscillator as claimed in claim 2, wherein the inner turn of the hairspring (3; 3') has a stiffened portion (3*d*) and/or is shaped as a Grossmann curve.

7. The oscillator as claimed in claim 1, wherein the lack of equilibrium in the balance and the geometry of the hairspring are such that the average slope of each curve among said second curves (B1-B4; B1'-B4') representing the running of the oscillator owing to the lack of equilibrium in the balance has substantially the same absolute value as the average slope of the corresponding curve among said first curves (S1-S4; S1'-S4') representing the running of the oscillator owing to the weight of the hairspring, in the range of oscillation amplitudes of 150° to 280°.

8. The oscillator as claimed in claim 1, wherein the lack of equilibrium in the balance and the geometry of the hairspring are such that the maximum discrepancy in the running of the oscillator owing to the lack of equilibrium in the balance and to the weight of the hairspring between said vertical positions in the range of oscillation amplitudes of 150° to 280° is less than 4 seconds/day.

9. The oscillator as claimed in claim 1, wherein the distance (R) between the inner end (3*a*) of the hairspring (3') and the center of rotation (O) of the hairspring (3') is greater than 500 μm.

10. The oscillator as claimed in claim 1, wherein the imbalance of the balance is greater than 0.5 μg·cm.

11. The oscillator as claimed in claim 1, wherein the inner turn of the hairspring (3; 3') has a stiffened portion (3*d*) and/or is shaped as a Grossmann curve.

12. The oscillator as claimed in claim 11, wherein the outer turn of the hairspring (3; 3') has a stiffened portion (3*c*).

13. The oscillator as claimed in claim 1, wherein the hairspring has a stiffness and/or a pitch which vary continuously over at least several turns.

14. The oscillator as claimed in claim 1, wherein the lack of equilibrium in the balance and the geometry of the hairspring are such that the maximum discrepancy in the running of the oscillator owing to the lack of equilibrium in the balance and to the weight of the hairspring between said vertical positions in the range of oscillation amplitudes of 150° to 280° is less than 2 seconds/day.

15. The oscillator as claimed in claim 1, wherein the lack of equilibrium in the balance and the geometry of the hairspring are such that the maximum discrepancy in the running of the oscillator owing to the lack of equilibrium in the balance and to the weight of the hairspring between said vertical positions in the range of oscillation amplitudes of 150° to 280° is less than 1 second/day.

16. The oscillator as claimed in claim 1, wherein the lack of equilibrium in the balance and the geometry of the hairspring are such that the maximum discrepancy in the running of the oscillator owing to the lack of equilibrium in the balance and to the weight of the hairspring between said vertical positions in the range of oscillation amplitudes of 150° to 280° is less than 0.7 seconds/day.

17. The oscillator as claimed in claim 1, wherein the distance (R) between the inner end (3*a*) of the hairspring (3') and the center of rotation (O) of the hairspring (3') is greater than 600 μm.

18. The oscillator as claimed in claim 1, wherein the distance (R) between the inner end (3*a*) of the hairspring (3') and the center of rotation (O) of the hairspring (3') is greater than 700 μm.

19. The oscillator as claimed in claim 1, wherein the imbalance of the balance is greater than 1 μg·cm.

20. The oscillator as claimed in claim 3, wherein the inner turn of the hairspring (3; 3') has a stiffened portion (3*d*) and/or is shaped as a Grossmann curve.

* * * * *